4,330,729

United States Patent [19]

Byrne

[11] 4,330,729

[45] May 18, 1982

[54] LOCKING SUPPORT ARRANGEMENT FOR A FLEXIBLE SOUND-GENERATING DIAPHRAGM

[75] Inventor: Michael Byrne, Farranshone, Ireland

[73] Assignee: General Electric Company, New York, N.Y.

[21] Appl. No.: 173,637

[22] Filed: Jul. 30, 1980

[51] Int. Cl.[3] ..... H04R 17/10

[52] U.S. Cl. ..... 310/322; 179/110 A

[58] Field of Search ..... 310/322, 324, 335; 179/101, 102, 103, 110 A; 367/157, 160, 161, 163, 165

[56] References Cited

U.S. PATENT DOCUMENTS

| | | | |
|---|---|---|---|
| 1,164,836 | 12/1915 | Manson . | |
| 3,510,698 | 5/1970 | Massa | 310/335 |
| 3,708,702 | 1/1973 | Brunnert | 179/110 A |
| 3,872,470 | 3/1975 | Hoerz et al. | 340/384 E |
| 3,921,016 | 11/1975 | Livermore et al. | 310/324 |
| 4,063,049 | 12/1977 | Pipitone et al. | 179/110 A |
| 4,277,839 | 7/1981 | McKinney | 367/165 |
| 4,295,009 | 10/1981 | Weidler | 179/110 A |

*Primary Examiner*—J. D. Miller
*Assistant Examiner*—D. L. Rebsch
*Attorney, Agent, or Firm*—George R. Powers; Leonard J. Platt; John F. Cullen

[57] ABSTRACT

A support arrangement for readily mounting the diaphragm of a piezoelectric transducer on a desired node ring, the diaphragm having coaxially mounted thereon a circular piezoelectric element having a diameter substantially the same as that of the node ring. The diaphragm is axially clamped on the node ring between first and second support members. The first support member includes first locking means extending therefrom into engagement with the second support member to axially lock the first and second support members together, and the second support member includes second locking means extending therefrom into locking engagement with the first locking means to lock the first locking means in engagement with the second support member.

14 Claims, 5 Drawing Figures

LOCKING SUPPORT ARRANGEMENT FOR A FLEXIBLE SOUND-GENERATING DIAPHRAGM

BACKGROUND OF THE INVENTION

1. Field of the Invention

This invention relates to a locking support arrangement for supporting a flexible sound-generating diaphragm and, more particularly, to a locking arrangement for clamping the diaphragm in position and preventing inadvertent disassembly.

2. Description of Prior Art

Piezoelectric transducers driven by a small disk of piezoceramic material bonded to a thin metal diaphragm are well known. When an appropriate electrical signal is applied to the disk, the disk changes its diameter, causing the composite structure of the piezoceramic disk and the metal diaphragm to flex accordingly from a flat shape into either a convex or concave shape. As the polarity of the electrical input signal changes, the shape of the flexible diaphragm also changes. By varying the polarity of the input signal at a particular frequency, the flexible diaphragm can be made to vibrate at the same frequency. To produce sound, some portion of the flexible diaphragm must be mounted to a fixed surface. This is typically accomplished by securing the diaphragm to an annular support surface by means of clamping or gluing. For loud sound, it is common to mount the diaphragm on a node ring of the diaphragm for the particular exciting frequency. The prior art mounting arrangements typically require careful alignment of the diaphragm and the support elements in order to assure that the diaphragm is secured on the desired node ring. In many instances the diaphragm is attached to the support member by a rubber-like cement which requires a period of time for curing.

By co-pending application Ser. No. 94,965 filed Nov. 16, 1979, now U.S. Pat. No. 4,302,695 in the names of Robert L. Boyles and Samuel Polonsky for "Support Arrangement for a Flexible Sound Generating Diaphragm" and assigned to the same assignee as this invention, an improved mounting arrangement for piezoelectric transducer-driven diaphragms is disclosed. The mounting arrangement taught therein comprises a substantially rigid support member and a clamping spider having annular means thereon for positioning and clamping a diaphragm between the rigid support member and the clamping spider on a node circle of vibration. The support members and the clamping spider are snapped together to rapidly and accurately provide the diaphragm mounting on the desired node ring. The clamping force is provided by resilient leg portions which extend from the spider into axial clamping engagement with the rigid support member. Assembly occurs due to radial camming action between the leg portions and the support member as the members are forced together axially. While this approach has been very effective, it is desirable that assurance be provided that the leg portions will not eventually release their hold on the support member.

SUMMARY OF THE INVENTION

It is therefore an object of this invention to provide a mounting arrangement for piezoelectric transducers that provides a high degree of assurance that the clamping force on the transducer will not be inadvertently released.

Another object of the invention is to provide an improved piezoelectric transducer assembly that can be rapidly and easily assembled with a high degree of accuracy while also providing assurance that the clamping force on the transducer will not be inadvertently released.

Briefly stated, in carrying out the invention in one form, a sound generating device includes a thin flexible diaphragm having a central axis perpendicular to the plane of the diaphragm, a first support member axially located on a first side of the diaphragm, and a second support member located on a second side of the diaphragm. The first and second support members each include substantially rigid support means projecting axially therefrom into clamping contact with the respective side of the diaphragm in axial and concentric alignment with each other on a given node circle of vibration of the diaphragm. The first support member further includes first locking means extending therefrom into engagement with the second support member to axially lock the support member together with the diaphragm clamped therebetween, and the second support member includes second locking means extending therefrom into locking engagement with the first locking means to lock the first locking means in engagement with the second support member. By a further aspect of the invention, the first locking means comprises a plurality of spaced-apart legs extending therefrom in a generally axial direction with at least a portion of the second support means being axially and radially interposed between the first support member and the distal ends of the legs. The axial length of the legs is such that the axial clamping force is exerted upon the second support member by the distal ends of the legs to maintain the diaphragm in its clamped position. The legs are radially and axially resilient in order to facilitate assembly and assure adequate clamping force on the diaphragm. By still further aspects of the invention, the second locking means comprises a like plurality of tabs each associated with a respective one of the legs, and each tab extends from the second support member substantially around the respective leg to substantially prevent undesired radial flexing of the leg. The legs are located radially outwardly of the second support member, and each of the tabs is connected at the end thereof to the second support member and extends radially and circumferentially therefrom to form with the second support member circumferential slots for receiving the respective legs. The legs are received in the circumferential slots such that the tabs prevent radially outwardly deflection of the legs. The distal ends of the legs and the tabs, along with the respective mating portions of the second support member and the legs, respectively, are provided with complementary cam and locking surfaces for facilitating assembly and preventing undesired disassembly.

DESCRIPTION OF A PREFERRED EMBODIMENT

Figure 1:
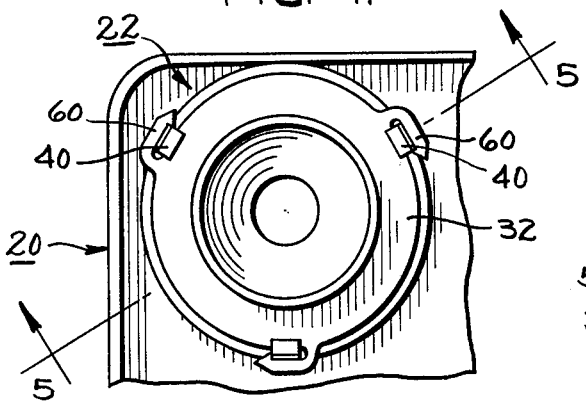
FIG. 1 is a plan view of a sound generating device incorporating the locking means of this invention.
Figure 2:
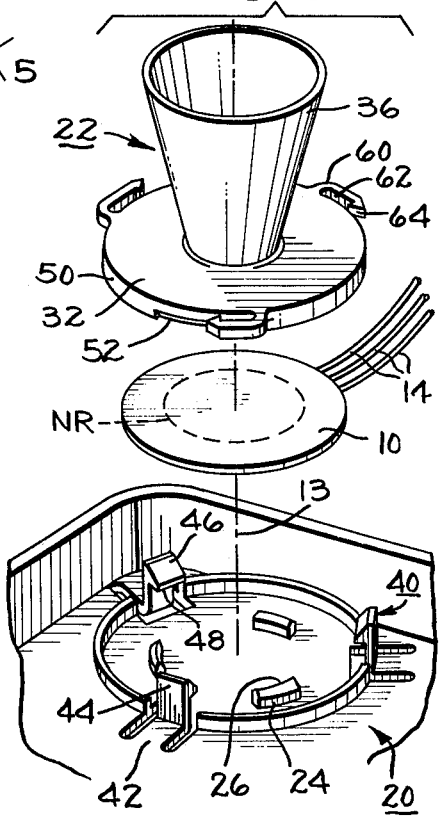
FIG. 2 is an exploded perspective view showing a flexible diaphragm positioned between the first and second support members.
Figure 5:
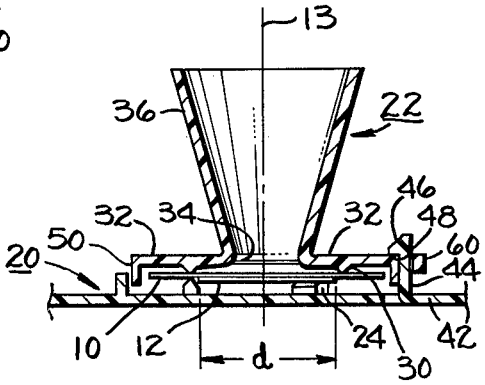
FIG. 5 is a cross-sectional view of the sound generating device taken along viewing line 5—5 of FIG. 1.

Referring to the drawings and particularly to FIGS. 2 and 5, the sound generating device of this invention includes a thin, circular flexible diaphragm disk 10 of brass or the like to which a thin circular disk 12 of special piezoceramic material is bonded, the two disks being disposed on a common central axis 13 perpendicular to the plane of the diaphragm as illustrated by FIGS. 2 and 5. The piezoceramic material changes its diameter slightly when an electric signal is applied across its surfaces from electrical leads 14. When the voltage on one surface of the piezoceramic disk is greater than the voltage on the other surface of the disk 12, the nominal diameter "d" of the disk 12 changes by a small amount "Δ". Since the disk 12 is bonded to the flexible diaphragm 10, this change in the diameter of the disk 12 causes the diaphragm 10 to bend from its normal flat shape to a new shape in which its upper surface becomes either convex or concave. Similarly, when the polarity of the applied voltage reverses, the diameter of the ceramic disk 12 changes in the opposite sense by a small amount "Δ". This opposite change in diameter causes the diaphragm 10 to flex in the opposite direction. If the voltage applied to the terminals 18 and 22 alternates at a selected frequency "f", the diaphragm 10 will flex between convex and concave shapes at the same frequency "f". By proper mounting, the vibration of the diaphragm 10 at the selected frequency "f" can be used to product audible sound at the frequency "f".

The diaphragm 10 and disk 12 assembly have a natural node ring as indicated by the broken line "NR" of FIG. 2, the node ring "NR" being coaxially disposed about the central axis 13 of the flexible disk 10. The node ring "NR" is established by the physical characteristics of the diaphragm and ceramic disk assembly. To produce maximum sound output, it is desirable that the selected frequency "f" at which the diaphragm assembly is vibrated be as close as possible to the frequency which will naturally cause the assembly to flex about the node ring "NR" and that the diaphragm 10 be securely mounted on the node ring such that the diaphragm at the node ring is held stationary while the remaining portions of the diaphragm radially inside and outside of the node relative to the central axis 13 are permitted to vibrate freely at the exciting frequency. In accordance with the present invention, and for reasons which will soon become apparent, the nominal diameter "d" of the piezoceramic disk 12 is made slightly smaller than the diameter of the node ring. As a practical matter, the node ring "NR" and the ceramic disk 12 are coaxially located and have substantially equal diameters.

Piezoceramic transducers of the type described generally above are widely available and the actual construction and composition of such transducers play no role in the present invention. One source of such transducers is the Piezo Product Division of Gulton Industries, Inc., located in Fullerton, California. Gulton sells such transducers under the generic description, "CATT Ⓣ tone transducers", where CATT Ⓣ means "ceramic audio tone transducers".

Figure 3:
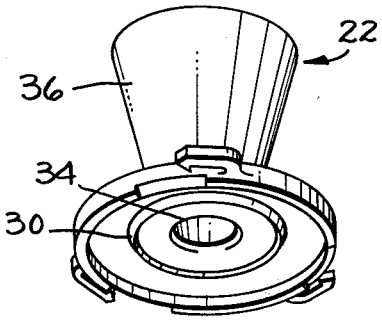
FIG. 3 is an underview of the second support member showing the support means thereon.

In accordance with the present invention, an improved mounting and locking arrangement is provided for permitting quick and accurate assembly and support of the flexible diaphragm 10 on the node ring "NR". As best shown by FIGS. 2, 3, and 5, a first support member 20 is located on one side of the diaphragm 10, and a second support member 22 is located on the other side of the diaphragm 10. The first support member 20 is formed of plastic or the like, and it includes a number of spaced-apart support elements 24 projecting axially therefrom toward the disk 10. The support elements 24 terminate in V-shaped ridge portions 26 facing the disk 10, the support elements 24 being disposed in a circular configuration having a diameter at the V-shaped ridge portions 26 substantially equal to the diameter of the node circle "NR". The second support member 22 is also formed of plastic or the like, and it includes an annular support element 30 which also has a V-shaped ridge configuration and extends axially from the support member 22 toward the disk or diaphragm 10. The circular support means 30 also has a diameter substantially equal to the diameter of the node circle "NR" of the diaphragm 10. The support elements 24 and 30 are substantially rigid. Since the support elements 24 and 30 have the same diameter as the node ring "NR", the diaphragm 10 may be coaxially clamped between the support members 20 and 22 with the elements 24 and 30 rigidly supporting the disk 10 on the node ring "NR". The unique locking means of this invention which will be described presently, assures that the support elements 24 and 30 of the first and second support members 20 and 22 respectively are coaxially aligned on the central axis 13 when assembled. Since the outer diameter "d" of the piezoceramic disk 12 is just slightly smaller than the diameter of the node ring "NR", the piezoceramic disk 12 cooperates with the adjacent support element (24 in the illustrated embodiment) to assure that the disk 10 is also secured on the central axis 13 between the substantially rigid support elements 24 and 30.

The second support member 22 also includes an annular ring 32 to which a Helmholtz resonator 36, horn or the like can be attached to amplify the acoustic output of the vibrating diaphragm 10, opening 34 being provided within the annular ring 32 to permit the acoustic output to reach the ambient atmosphere through a resonator or horn 36 attached to the ring 32.

The first support member 20 also includes three circumferentially spaced-apart legs 40 each including a base section 42 connected to the support member 20 in a cantilever manner with the base section 42 disposed in a plane perpendicular to the central axis 13 such that the base section 42 can flex resiliently in an axial direction relative to the central axis 13. The legs 40 also have leg portions 44 each connected to the unsupported ends of the respective base section 42 and extending therefrom axially toward the second support member 22. The leg portions 44 are radially resilient due both to the inherent flexibility of the plastic material from which they are made and the axial resilience of the base sections 42. The distal ends of the leg portions 44 include a cam surface 46 and a locking surface 48 which cooperate with complementary portions of the second support member 22 in a manner hereinafter described.

The outer periphery of the annular ring 32 of second support member 22 terminates in a cylindrical ring 50 which has formed integrally therewith three circumferentially spaced-apart cam surfaces 52 on the edge of the ring 50 facing the first support member 20. The cam surfaces 52 are radially and circumferentially aligned with the cam surfaces 46 at the distal ends of the legs 40 such that axial movement of the second support member 22 along the central axis 13 toward the first support member 20 will result in contact between the aligned surfaces 46 and 52. Continued axial movement of the support members 20 and 22 toward each other will cause the leg portions 44 to be biased radially outwardly. The distal ends of the legs 40 also include locking surfaces 48 adopted to engage the upper surface of the annular ring 32 as shown by FIG. 5. The resilient construction of the legs 40 and the complementary cam portions 46 and 52 thus permits axial assembly of the sound generating device, the leg portions 44 deflecting radially outwardly to pass over the outer periphery of the ring 50 and then moving radially inwardly to bring the locking surfaces 48 into contact with the upper surface of the annular ring 32. The resilience of the base sections 42 of the legs 40 assures that the legs 40 will resiliently urge the rigid support elements 24 and 30 into engagement with the coaxial diaphragm 10.

Figure 4:
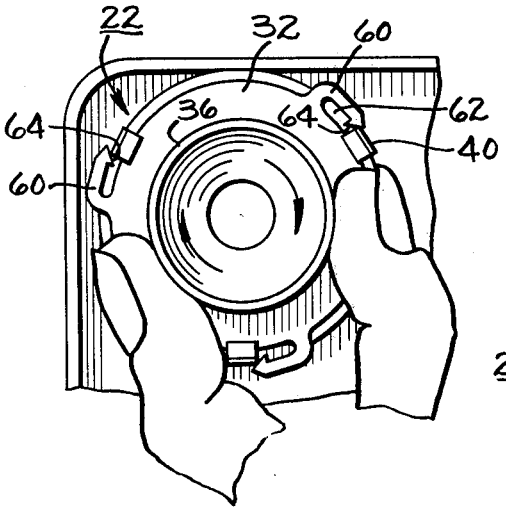
FIG. 4 illustrates assembly of the parts of the sound generating device, the fully assembled device being shown by FIG. 1.

In accordance with the invention, the second support member 22 also has three locking tabs 60 extending outwardly and circumferentially of the cylindrical ring 50. Each tab 60 cooperates with the ring 50 to form therebetween a slot 62 as best shown by FIGS. 2, 4, and 5, the slot 62 being of a size and configuration to receive therein a respective one of the legs 40 when the first and second support member are locked together. The distal end of each tab 60 is located adjacent a respective cam surface 52 and has on its end a cam surface 64. After the first and second support members 20 and 22 are snapped together axially into the position substantially illustrated by FIG. 4 with the locking surfaces 48 of the legs 40 engaging the annular surface 32, the second support member 22 is rotated clockwise as shown by FIG. 4. As this occurs, the cam surface 64 engages the respective leg 40 and is biased radially outwardly such that the leg 40 enters the slot 62. The resilient tab 60 then deflects radially inwardly, trapping the leg 40 in the slot 62.

As a result of the tab and leg arrangement of this invention, the diaphragm 10 is securely trapped between the rigid support elements 24 and 30 of the first and second support members 20 and 22, respectively. More particularly, the legs 40 engage the annular ring 32 of the second support member to maintain the axial engagement of the parts, and the tabs 60 in turn resiliently hold the legs 40 in their locked position. As a result, the remote possibility that one of the legs 40 might move outwardly and thus release the diaphragm is further reduced, and the reliability of the sound-producing device is still further enhanced.

From the foregoing, it will be seen that the mounting arrangement of this invention facilitates the rapid and accurate assembly of a piezoelectric transducer. More particularly, the invention provides a highly accurate and simple mounting which permits the precise initial and permanent positioning and mounting of a vibrating transducer element on a desired node ring while at the same time providing a high degree of assurance that the clamping force on the transducer will not be inadvertently released.

While the invention has been particularly shown and described with reference to a preferred embodiment thereof, it will be understood by those skilled in the art that various changes in form, details, and application may be made therein without departing from the spirit and scope of the invention. Accordingly, it is intended that all such modifications and changes be included within the scope of the appended claims.

What is claimed as new and is desired to secure by Letters Patent of the United States is:

1. A sound generating device comprising:

a thin flexible diaphragm having a central axis perpendicular to the plane of the diaphragm, a first support member axially located on a first side of said diaphragm, a second support member axially located on a second side of said diaphragm, said first and second support members each including substantially rigid support means projecting axially therefrom into clamping contact with the respective side of said diaphragm, said support means being axially aligned with each other on said central axis and said support means both being disposed in a circular configuration concentric with said central axis and having a diameter substantially equal to a given node circle of vibration of said diaphragm, said first support member further including first locking means extending therefrom into engagement with said second support member to axially lock said first and second support members together and thereby maintain said diaphragm in its clamped position between said first and second support means, said second support member further including second locking means extending therefrom into locking engagement with said first locking means to lock said first locking means in engagement with said second support member, and means for vibrating said diaphragm to produce sound.

2. A sound generating device as defined by claim 1 in which said means for vibrating said diaphragm comprises a piezoelectric electromechanical transducing element coaxially attached to said diaphragm and projecting axially therefrom toward one of said support members, said piezoelectric element having a circular periphery of a diameter to closely fit within the inner diameter of the facing one of said support means, whereby assembly of the sound-generating device with said piezoelectric element located within the respective support means assures that said diaphragm is clamped between said support members on said node circle of vibration of said diaphragm.

3. A sound generating device as defined by claim 1 in which said first locking means comprises a plurality of spaced-apart legs extending from said first support member in a generally axial direction, at least a portion of said second support means being axially and radially interposed between said first support member and the distal ends of said legs, the axial length of said legs being such that axial clamping force is exerted upon said second support member by the distal ends of said legs to maintain said diaphragm in its clamped position between said first and second support members.

4. A sound generating device as defined by claim 3 in which said legs are radially resilient.

5. A sound-generating device as defined by claim 4 in which said means for vibrating said diaphragm comprises a piezoelectric electromechanical transducing element coaxially attached to said diaphragm and projecting axially therefrom toward one of said support members, said piezoelectric element having a circular periphery of a diameter to closely fit within the inner diameter of the facing one of said support means, whereby assembly of the sound generating device with said piezoelectric element located within the respective support means assures that said diaphragm is clamped between said support members on said node circle of vibration of said diaphragm.

6. A sound generating device as defined by claim 4 in which said legs are axially resilient.

7. A sound generating device as defined by claim 4 in which said second locking means comprises a like plurality of tabs each associated with a respective one of said legs, each of said tabs extending from said second support member substantially around said respective leg to substantially prevent undesired radial flexing of said leg.

8. A sound-generating device as defined by claim 4 in which said second support member and the distal ends of said legs include complementary cam means for facilitating axial assembly of the sound-generating device and complementary locking surfaces through which axial force is exerted upon said second support member by said legs.

9. A sound-generating device as defined by claim 8 in which said legs are axially resilient.

10. A sound-generating device as defined by claim 8 in which said legs are located radially outwardly of said second support member and in which said tabs are connected at one end thereof to said second support member and extend radially and circumferentially therefrom to form with said second support member circumferential slots for receiving the respective legs, said tabs substantially preventing radially outward deflection of said legs when said legs are received in the respective circumferential slots.

11. A sound generating device as defined by claim 10 in which said legs and the distal ends of said tabs include complementary cam means for facilitating relative circumferential movement of said legs into said slots following axial assembly of the sound generating device.

12. A sound-generating device as defined by claim 11 in which said tabs and said legs include complementary locking surfaces for substantially preventing circumferential disassembly of said legs from said slots.

13. A sound-generating device as defined by claim 12 in which said legs are axially resilient.

14. A sound-generating device as defined by claim 13 in which said means for vibrating said diaphragm comprises a piezoelectric electromechanical transducing element coaxially attached to said diaphragm and projecting axially therefrom toward one of said support members, said piezoelectric element having a circular periphery of a diameter to closely fit within the inner diameter of the facing one of said support means, whereby assembly of the sound-generating device with said piezoelectric element located within the respective support means assures that said diaphragm is clamped between said support members on said node circle of vibration of said diaphragm.

* * * * *